US005577527A

United States Patent [19]

Jacobs et al.

[11] Patent Number: 5,577,527

[45] Date of Patent: Nov. 26, 1996

[54] METHOD AND APPARATUS FOR DISPENSING DETERGENT TO A DISHWASHING MACHINE

[76] Inventors: David P. Jacobs, 6531 Point Clear, Houston, Harris County, Tex. 77069; Gaston Gaal, 11818 Burlingame Dr., Houston, Harris County, Tex. 77099-4702

[21] Appl. No.: 419,455

[22] Filed: Apr. 10, 1995

[51] Int. Cl.[6] ..... B01D 11/02; B67B 7/00

[52] U.S. Cl. ..... 137/268; 222/457; 422/266

[58] Field of Search ..... 137/268; 222/457; 422/266, 279

[56] References Cited

U.S. PATENT DOCUMENTS

| | | | |
|---|---|---|---|
| Re. 17,407 | 8/1929 | Lane . | |
| 1,175,870 | 3/1916 | Iscra . | |
| 1,408,921 | 5/1922 | Robert | 222/457 |
| 1,757,140 | 5/1930 | Pulkinghorn | 422/266 |
| 2,601,672 | 6/1952 | Gatchet | 422/266 |
| 2,723,905 | 11/1955 | Coakley . | |
| 2,842,465 | 7/1958 | Harrison . | |
| 3,333,773 | 8/1967 | Hutchinson . | |
| 3,595,438 | 7/1971 | Daley et al. . | |
| 3,850,344 | 11/1974 | Burge et al. . | |
| 3,900,857 | 11/1976 | Vandenhoeck | 222/457 |
| 4,094,448 | 6/1978 | Häseler et al. | 222/457 X |
| 4,333,493 | 6/1982 | Beiswenger et al. . | |
| 4,437,593 | 3/1984 | Bullock, III . | |
| 4,462,511 | 7/1984 | Fulmer et al. | 422/261 |
| 4,571,327 | 2/1986 | Larson et al. | 422/263 |
| 4,576,219 | 3/1986 | Uram . | |
| 4,666,682 | 5/1987 | Mayer et al. | 422/261 |
| 4,687,121 | 8/1987 | Copeland . | |
| 4,690,305 | 9/1987 | Copeland | 222/52 |
| 4,790,981 | 12/1988 | Mayer et al. | 422/263 |
| 4,883,203 | 11/1989 | Kittscher . | |
| 5,007,559 | 4/1991 | Young | 222/1 |
| 5,218,983 | 6/1993 | King | 137/268 |
| 5,229,084 | 7/1993 | Livingston et al. | 422/278 |
| 5,441,073 | 8/1995 | Hoadley | 137/268 |
| 5,483,989 | 1/1996 | Lim | 137/268 |

*Primary Examiner*—Edward K. Look
*Assistant Examiner*—Michael S. Lee
*Attorney, Agent, or Firm*—Browning, Bushman, Anderson & Brookhart

[57] ABSTRACT

A container for use in liquifying granular detergent and thereafter dispensing such liquified detergent to an industrial dishwashing machine, in which the container has a threaded end cap having a 2" center hole through its 4" diameter flat end and a flush plate attached to the end cap through a parallel spacing of ⅛". Hot water is directed through the space between the end cap and the flush plate, with a portion of the hot water being diverted through the hole in the end cap to engage any detergent not falling through the hole onto the flush plate.

14 Claims, 2 Drawing Sheets

METHOD AND APPARATUS FOR DISPENSING DETERGENT TO A DISHWASHING MACHINE

BRIEF DESCRIPTION OF THE INVENTION

The present invention relates, generally, to a new and improved method and apparatus for safely and efficiently dispensing a highly caustic, granular detergent into a high volume, commercial dishwashing machine.

BACKGROUND OF THE INVENTION

In an industrial washing environment, such as a hospital, hotel, or large restaurant, there is a need to wash a large number of dishes and related material at various times during the day. For this purpose there have been developed industrial washing machines which operate at relatively high temperatures and utilize automatic systems for controlling and dispensing the water, detergent, and other materials to the interior portion, or washing volume of the machine. One element of these automatic systems is a dispensing apparatus for dispensing detergent into the washing machine in controlled amounts. These detergent dispensing apparatus have suffered from some deficiencies in operation and longevity, among others.

An example of such an apparatus includes a reservoir pivotably secured to a side wall of the washing machine. This system requires moving parts to permit rotation of the reservoir. The reservoir is configured to receive a batch of detergent for dispensing purposes. The detergent may be in a container having external threaded portions which will interact with the threaded bore in the reservoir. A screen fixed to the reservoir separates the detergent from the reservoir outlet. A water delivery system sprays water onto the detergent to dissolve the detergent sufficiently to pass through the screen and be dispensed into the washing machine.

A problem with this system is the number of operating parts that are involved. The rotating apparatus will eventually either leak or break. As a result, the rather caustic soap material can be spilled onto the floor, as well as over other operating elements of the washing machine. Hot water can be sprayed inadvertently beyond the reservoir causing damage to the operators and others in the vicinity of the washing machine. Even with a screw-on container, it is rather awkward to fix a large container into the receptacle without spillage or other malfunction.

Another apparatus employs an open reservoir into which the detergent is simply poured from a soft bag into a conical screen. This system suffers from a number of deficiencies relating to spillage and damage to the machine and injury to the operator. Spillage occurs in attempting to deliver the detergent from the soft bag to the reservoir. The detergent, once wetted, becomes caustic material and causes injury to the operators and also erodes portions of the machine to the extent where certain elements have to be replaced.

Prior Art

The prior art has attempted to overcome such deficiencies in a number of different ways. For example, in U.S. Pat. No. 5,007,559 to Cecil B. Young, issued on Apr. 16, 1991, there is described a disposable container having a screen of wire mesh across the mouth of the container, the mesh size of the screen being selected to contain the detergent granules, in the dry condition or state. A water nozzle is directed along the longitudinal axis of the container to cause hot water to pass through the wire mesh screen, contact the detergent granules to thereby liquify a portion of such granules and following liquification, to pass back through the wire mesh screen by gravity to enter a detergent dispensing bowl feeding the washing machine located in proximity to the detergent container.

In yet another approach to solving the deficiencies of the prior art, in U.S. Pat. No. 5,229,084 to James W. Livingston and Frederick J. Fulmer, issued on Jul. 20, 1993, a detergent dispensing cap is described which also uses a wire mesh screen to hold the dry detergent granules within the container, but which uses a dome-shaped distributor in the center of the wire mesh screen. In operation, the hot water from a nozzle oriented along the longitudinal axis of the detergent container, jets into the distributor, without passing through the apertures in the screen, and is sprayed radially onto the dry detergent granules. As the detergent granules are contacted by the hot water, the granules are liquified and fall by gravity back through the wire mesh screen into a detergent dispensing bowl feeding the dishwashing machine located in proximity to the detergent container.

While the dishwashing methods and apparatus of the prior art have enjoyed considerable amounts of success, the prior art has not been without its problems. In U.S. Pat. No. 5,007,559, for example, because the hot water must be sprayed through the wire mesh screen before making contact with the detergent granules, the water pressure must be maintained at a fairly high valve. By having very hot water, at a fairly high pressure, the hot water will sometimes tend to "channel" through the detergent granules and impinge upon the sides or top surface of the plastic container housing the detergent granules.

Those people skilled in this art know that such plastic containers are generally constructed of either polyethylene or polypropylene. Polyethylene has, for the most part, been the material of choice in this industry, because it is relatively soft, and not apt to crack or break, if used in cold climates, when dropped on hard surfaces while full of the dry detergent granules. However, whenever the hot water under high pressure channels through the detergent granules, thereby generating a very hot, high pressure, highly caustic stream, and strikes the polyethylene side or top surface of the container, the polyethylene structure can literally be burned out, with the ensuing hot water containing the caustic solution (sodium hydroxide) possibly spraying into the room onto any personnel in attendance with the dishwasher. To overcome that problem, those skilled in this art have sometimes chosen to use the polypropylene containers. While polypropylene has a higher melting point than that of polyethylene, it is harder and more likely to crack or break in colder climates when dropped on hard surfaces. Moreover, if the container used in the U.S. Pat. No. 5,007,559 is removed during the dishwashing operation, the only thing preventing the hot water from shooting straight up, possibly into an operator's face, is a hot water control valve controlled by the insertion or removal of the container. If the control valve sticks or otherwise malfunctions, the water will in fact shoot straight up and possibly cause injury.

The system described in U.S. Pat. No. 5,229,084, would not tend to cause channeling of the high pressure, hot water as above-described, since the water does not need to be forced through the wire mesh screen prior to encountering the detergent granules. However, the system in U.S. Pat. No. 5,229,084, does depend upon keeping the wire mesh screen unclogged to allow the liquified detergent to pass therethrough. As soon as the hot water is cycled off, the screen can easily become clogged with detergent residue, which may or may not clear up whenever the water is again cycled on.

In addition to the foregoing U.S. Pat. Nos. 5,229,084 and U.S. Pat. No. 5,007,559, other examples of the prior art include U.S. Pat. Nos. Reissue 17,407 to Lane; 1,175,870 to Iscra; U.S. Pat. No. 2,723,905 to Coakley; U.S. Pat. No. 2,842,465 to Harrison; U.S. Pat. No. 3,333,773 to Hutchinson; U.S. Pat. No. 3,595,438 to Daley; U.S. Pat. No. 3,850,344 to Burge et al; U.S. Pat. No. 4,333,493 to Beiswenger et al; U.S. Pat. No. 4,437,593 to Bullock III; U.S. Pat. No. 4,462,511 to Fulmer et al; U.S. Pat. No. 4,571,327 to Larson et al; U.S. Pat. No. 4,576,219 to Uram; U.S. Pat. No. 4,666,682 to Mayer et al; U.S. Pat. No. 4,687,121 to Copeland; U.S. Pat. No. 4,690,305 to Copeland; U.S. Pat. No. 4,790,981 to Mayer et al; and U.S. Pat. No. 4,883,203 to Kittscher, none of which provides a solution to the problems above discussed.

OBJECTS OF THE INVENTION

It is therefore the primary object of the present invention to provide a new and improved method and apparatus for dispensing detergent into a dishwashing machine.

It is another object of the present invention to provide a new and improved method and apparatus having no dependency upon a wire mesh screen for holding dry detergent granules within a container used in conjunction with a dishwashing machine.

SUMMARY OF THE INVENTION

These and other objects, features, and advantages of the present invention are accomplished, generally, by the use of a detergent container having a cap which allows the detergent granules to drop onto an external plate, which in turn are washed off the plate by a stream of hot water directed along and horizontal to the external plate.

As an additional feature of the present invention, a portion of the hot water is diverted through the mouth of the container into contact with any detergent granules not dropping onto the external plate.

BRIEF DESCRIPTION OF THE DRAWINGS

For a better understanding of the invention, reference should be made to the following description taken in conjunction with the accompanying drawings, in which.

DETAILED DESCRIPTION OF THE PREFERRED EMBODIMENT

Figure 1:
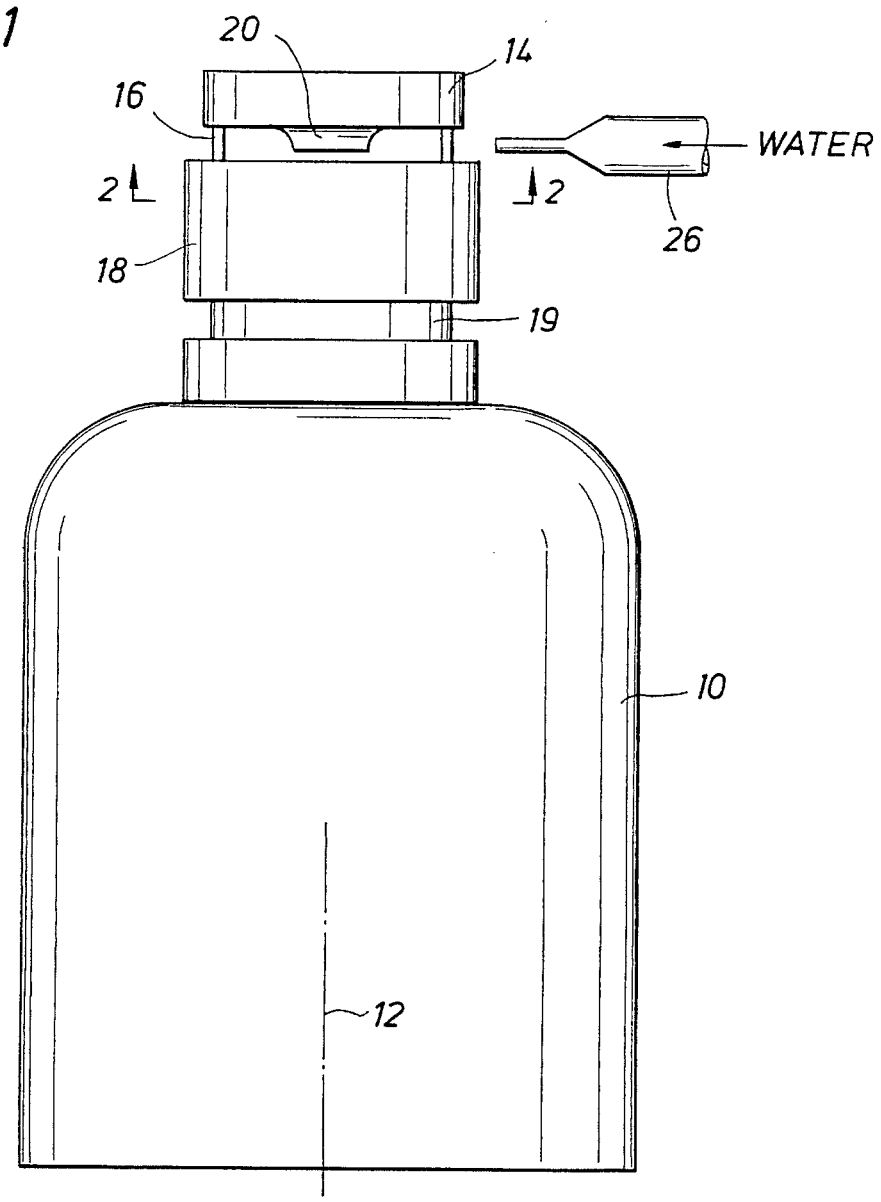
FIG. 1 is an elevated, pictorial view of a detergent container with the cap/plate configuration according to the present invention.

Referring now to FIG. 1, there is illustrated a container 10, preferably constructed of polyethylene, for holding dry, granulated detergent, the container 10 having a longitudinal axis 12. Because the primary use of the invention will be in conjunction with high volume washing machines such as are commonly used in restaurants, hospitals, hotels, and the like, the detergent will typically be highly caustic, for example, 40% sodium hydroxide.

The container 10 has a dispenser cap 18 having internal threads 24 adapted to thread onto external threads (not illustrated) on a neck portion 19 of container 10. The cap 18 has a plate 14 attached a given distance away from the flat surface 22 of the cap 18 by a plurality of screws or bolts 16. Although the plate 14 and the cap 18 are illustrated as being held together by screws or bolts 16, it is contemplated that the cap 18 and plate 14 can be molded as one piece, for example, from polypropylene for added hardness, while maintaining separation between the plate 14 and cap 18 through integrally molded spacers to replace the screws or bolts 16. Thus, it is contemplated that the plate 14, spacers and cap 18 can be molded as one piece. In an alternative method of manufacturing the cap/plate configuration, the one-eighth inch (⅛") hard plastic spacers can be sonically welded between the cap 18 and plate 14.

In preparing the final design of the cap and plate configuration, several phases of the design were configured, with varying degrees of success.

PHASE 1

A 1"(1.0") diameter, circular hole 28 was formed in the center of the flat portion 22 of the cap 18. The flat portion 22 has a nominal diameter of 4", which is common in this art. The plate 14 was also configured as having a circular 4" diameter, and was spaced parallel 1/16" from the cap 18. A jet of hot water from nozzle 26 was used but only with limited success.

PHASE 2

A 3¼"(3.25") diameter hole 28 was cut in the center of the flat portion 22 of cap 18. The cap 18 and plate 14 were again spaced parallel 1/16" apart, with the plate 14 again being 4" in diameter, matching the diameter of the cap 18. This configuration had only limited success.

PHASE 3

This was the same overall configuration as Phase 2, but with a parallel spacing between the cap 18 and plate 14 of ¼". This configuration had only limited success.

PHASE 4

A 1½" hole 28 (1.5") was formed in the center of flat portion 22 of cap 18. The plate 14 was spaced parallel ⅛" from the cap 18. A large headed screw was screwed into the interior center surface of the plate 14 in an attempt to divert some of the hot water into the mouth of the container. The cap 18 and plate 14 were each 4" in diameter. This configuration had only limited success.

PHASE 5

A 2"(2.0") diameter hole was formed in the center of the flat portion 22 of cap 18. The cap 18 and plate 14 were spaced parallel ⅛" apart. A star diverter (see FIG. 3) was attached on the interior center surface of plate 14 to enhance the diversion of the hot water into the mouth of the container 10. This configuration had somewhat greater success than the configuration of Phase 4.

PHASE 6

This configuration was the same as Phase 5, with the exception of the diameter of the plate 14 being reduced to 3½"(3.5"), while maintaining the cap diameter at 4"(4.0"). This reduced diameter of the plate 14 resulted in far greater flushing of the detergent from the interior of the container 10 and from the surface of the plate 14. The configuration of Phase 6, having a 2" hole in the center of the flat portion 22 of cap 18, coupled with a parallel spaced plate 14 (⅛" spacing) having a reduced diameter (3.5"), constitute the preferred embodiment of the invention.

Referring again to FIGS. 1 and 2 of the present invention, it should be appreciated that FIG. 2 is a plan view of the cap 18 taken along the sectional line 2—2 of FIG. 1. The plate 14 can be viewed in FIG. 2 through the hole 28 in the flat portion 22 of cap 18.

The hot water nozzle 26 is positioned within the dispensing bowl to cause hot water to enter the spacing between the plate 14 and cap 18. The deflector 20', described as a star deflector in Phases 5 and 6 above, and illustrated better in FIG. 3, causes a portion of the hot water to be deflected through the hole 28 to partially wet some of the particulate detergent in the container 10. A circular, approximately 4" in diameter, sheet of carboxymethyl-cellulose paper (CMC), not illustrated, is placed on the interior surface of the flat portion 22 of cap 18, to prevent the premature exit of the detergent granules from the container 10. The CMC paper will instantaneously dissolve when first hit by the hot water to allow the detergent to fall through the 2" hole 28 onto the plate 14.

When the container 10, having the cap 18 and plate 14 threadably attached thereto, and being filled with the granular detergent, is ready to be shipped to the end user, a strip of tape (not illustrated) is attached to the exterior of the cap 18/plate 14 combination to close-off the opening around the periphery of the combination. This tape, or other covering, which could, for example, be a shrink-wrap covering, prevents moisture from prematurely entering the spacing and attacking the CMC paper holding the detergent within the container.

Figure 2:
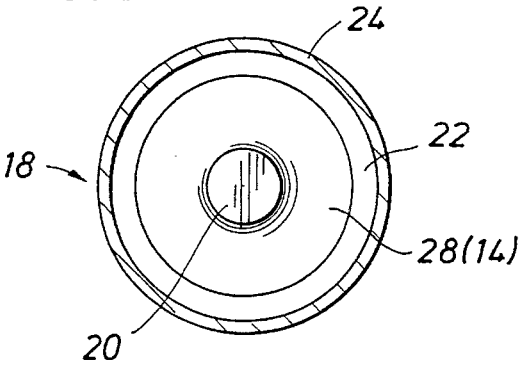
FIG. 2 is a plan view, partially in cross-section, of the cap according to FIG. 1, taken along the sectional line 2—2 of FIG. 1.
Figure 3:
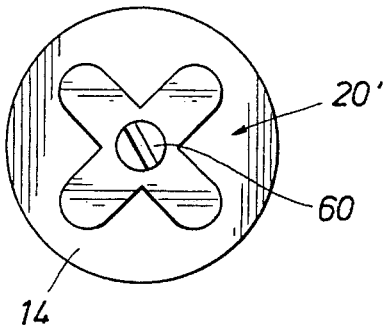
FIG. 3 is a top plan view of a divert which can be used with the configuration of FIG. 1 according to the present invention.

Referring now to FIG. 3, there is illustrated in plan view a diverter 20' which has proved in tests to function quite well as a substitute with the configuration illustrated in FIGS. 1 and 2. The diverter 20' is a hard plastic, for example, polypropylene, star configuration commonly used in the laying of quarry tile as a spacer bar. The particular diverter 20' has a hole drilled through its center to accept a screw 60 which is used to attach the diverter 20' to the center of the interior surface of plate 14. The diverter 20' is in practice ⅜" thick, but because the circumferential dimension of diverter 20' is less than the 2" diameter hole 28, it does not interfere with the ⅛" spacing between the plate 14 and the cap 18.

Figure 4:
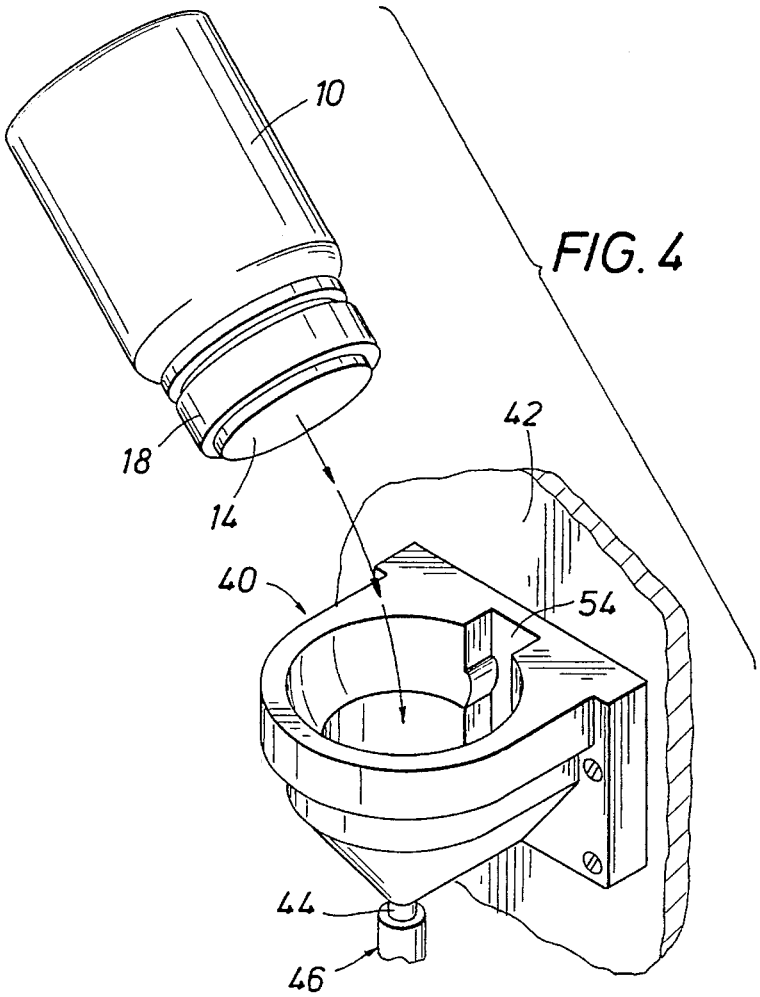
FIG. 4 is a perspective view of the container and the detergent dispenser bowl in a exploded disposition.
Figure 5:
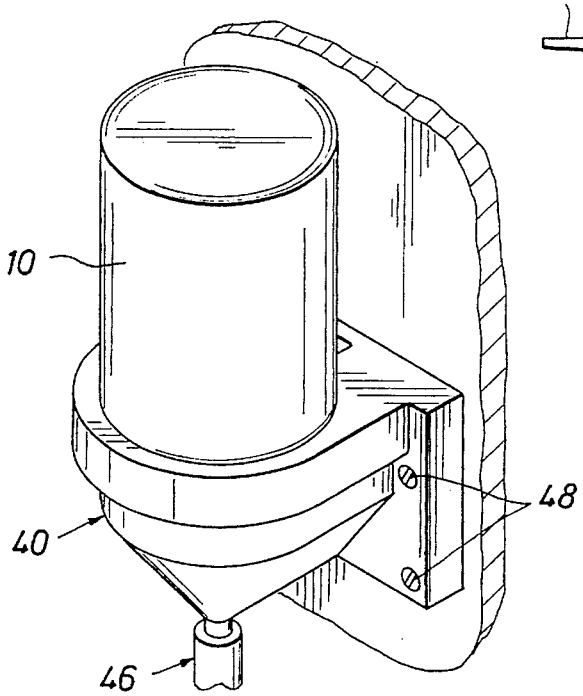
FIG. 5 is a perspective view of the container and the detergent dispenser bowl as illustrated in FIG. 4, but with the container in operative engagement with the detergent dispenser bowl.

In operation, the end user removes the tape and places the container in the prior art receptacle such as the one illustrated in FIGS. 4 and 5. It should be appreciated that the receptacle illustrated in FIGS. 4 and 5 is common in this industry, as is illustrated and described with respect to FIGS. 3 and 4, respectively, in U.S. Pat. No. 5,007,559, save and except for the hot water nozzle 26 of the present invention being configured to direct the hot water perpendicular to the longitudinal axis 12 of container 10, as contrasted with the water being injected in the prior art along and parallel to such longitudinal axis. The receptacle 40, sometimes referred to by those in this art as a detergent dispenser bowl, for receiving the container 10, is shown fixed to wall 42 of an industrial dishwashing machine (not otherwise illustrated) by means of screws or other fasteners 48. The receptacle 40 defines a number of internal surfaces generally in the form of a bowl for receiving the cap 18 and the plate 14 in an inverted disposition as illustrated in FIG. 5. These surfaces are specifically configured to interact with corresponding surfaces on the container 10 and cap 18 to ensure a snug fit.

The receptacle 40 includes an outlet 44 having a hose or pipe 46 leading to the internal portion of the dishwasher for distributing the liquified detergent from the bottom of receptacle 40.

Figure 6:
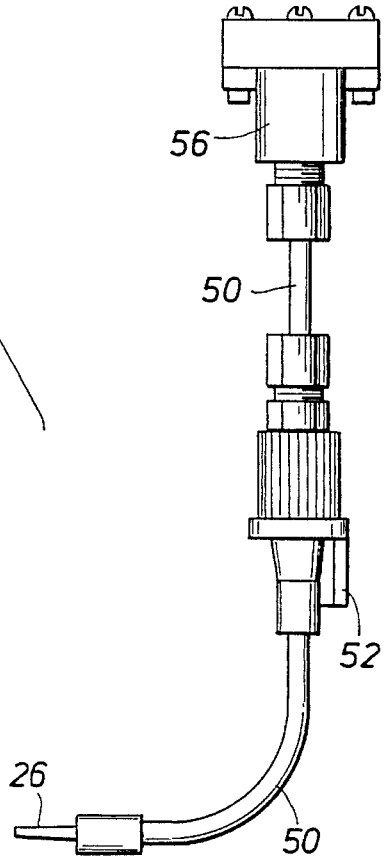
FIG. 6 is an elevated view of the retrofit hot water nozzle to be used in the detergent dispenser bowl of FIG. 4 in accordance with the present invention.

In FIG. 6, there is illustrated the nozzle 26 in some more detail to illustrate the retrofit configuration needed to practice the invention in conjunction with the receptacle of FIGS. 4 and 5. The hot water nozzle 26 is connected through piping 50 through a plastic housing 52 which is configured to slide into the opening 54 in FIG. 4. When totally in place, the squeezed down (somewhat flattened) nozzle 26 is located to direct hot water directly between the plate 14 and the flat surface 22 of cap 18. The piping 50 is connected through a conventional vacuum breaker 56 required by many county or municipal codes to avoid the soapy water from backing up into the city or county water supply. Although not illustrated, the water supply is connected directly into the vacuum breaker 56.

In the operation of the preferred embodiment illustrated in FIGS. 1–6, after the tape or other water-tight covering is removed from the exterior side of the cap 18/plate 14 combination, the container is placed in the receptacle illustrated in FIGS. 4 and 5. As the hot water first exits the nozzle 26 and instantaneously dissolves the CMC paper, granular detergent will fall onto the plate 14 in much the same manner as is involved in a bird feeder, i.e., as a bird eats bird seed, additional bird seed will fall out the bottom of the bird feeder. Although bird feeders are notoriously old and well-known, to the best of our knowledge, such a concept has never been used in a manner as to control the operation of a dishwashing machine.

Thus, after the CMC paper is dissolved, the granular detergent falls onto the plate 14, and is there liquified by hot water from the nozzle 26. The diverter 20' performs two functions, the first to dissolve the CMC paper, and thereafter to aid in causing the detergent to fall through the opening 28, onto the plate 14. The water from nozzle 26 is from time to time cycled on and off in response to the measured alkalinity of the liquified detergent as is commonly done in this art, for example, as in U.S. Pat. Nos. 5,007,559 and 5,229,084.

The foregoing operation has numerous advantages over the prior art. For example, we found that we could use a vastly reduced water pressure, approximately one-third of standard city water pressure in Houston, Tex. (approximately 40 p.s.i.), as compared to the full city water pressure required with the system illustrated in U.S. Pat. No. 5,007,559. Moreover, the elimination of the wire screen mesh eliminates a source of clogging within the system.

What is claimed is:

1. A container for dispensing detergent for use with a dishwashing machine having a complementary receptacle, comprising:

a hollow body portion containing dry, granular detergent, said container having a threaded neck portion and a mouth at one end of said threaded neck portion to allow access to the interior of said container;

a cap threadably connected to said threaded neck portion, said cap having a threaded sidewall and a flat surface at one end of said threaded sidewall and at least one orifice in said flat surface through which such granular detergent can easily pass; and a plate attached to and spaced a predetermined distance from said flat surface of said cap, whereby said dry, granular detergent can fall out of said container through said at least one orifice onto said plate and be flushed off said plate into said washing machine by hot water directed through the spacing between said plate and the flat surface of said cap.

2. The container according to claim 1, including in addition thereto, means connected to or formed with one surface of said plate for diverting a portion of said hot water through said at least one orifice into said container to contact the granular detergent in said container.

3. The container according to claim 1, wherein the flat surface of said cap is circular and of a given diameter, and the said plate is circular and of a diameter less than said given diameter.

4. The container according to claim 3, wherein the given diameter of the flat surface of said cap is 4" and the said at least one orifice is a single, circular hole having a diameter of 2" or less, located at the center of said flat surface, and the plate is circular and of a diameter of 3½".

5. The container according to claim 4, wherein the predetermined distance between said flat surface of the cap and the plate is ⅛".

6. The container according to claim 1, wherein said means for diverting a portion of the hot water comprises a diverting member having a thickness dimension greater than the said predetermined distance between the flat surface of the cap and the plate.

7. An end cap for use with a container for liquifying and dispensing dry, granular detergent to a dishwashing machine, comprising:

a cap having a threaded sidewall and a flat surface at one end of said threaded sidewall and at least one orifice in said flat surface through which such granular detergent can easily pass; and a plate attached to and spaced a predetermined distance from said flat surface of said cap, whereby said dry, granular detergent can fall out of said container through said at least one orifice onto said plate and be flushed off said plate into said washing machine by hot water directed through the spacing between said plate and the flat surface of said cap.

8. The end cap according to claim 7, including in addition thereto, means connected to or formed with one surface of said plate for diverting a portion of said hot water through said at least one orifice into said container to contact the granular detergent in said container.

9. The end cap according to claim 7, wherein the flat surface of said cap is circular and of a given diameter, and the said plate is circular and of a diameter less than said given diameter.

10. The end cap according to claim 9, wherein the given diameter of the flat surface of said cap is 4" and the said at least one orifice is a single, circular hole having a diameter of 2" or less, located at the center of said flat surface, and the plate is circular and of a diameter of 3½".

11. The end cap according to claim 10, wherein the predetermined distance between said flat surface of the cap and the plate is ⅛".

12. The end cap according to claim 7, wherein said means for diverting a portion of the hot water comprises a diverting member having a thickness dimension greater than the said predetermined distance between the flat surface of the cap and the plate.

13. A method of liquifying dry, granular detergent for use in a dishwashing machine, comprising:

a. at least partially filling a container with dry, granular detergent;

b. capping said container with a threaded cap having a flat end surface with at least one orifice in said flat end surface through which dry, granular detergent can easily pass, the flat end surface of said threaded cap being attached to a plate spaced a predetermined distance from said flat end surface; and c. causing hot water to enter the space being said flat end surface and said plate to thereby liquify granular detergent falling out of said container through said at least one orifice onto said plate.

14. The method according to claim 13, including the additional step of diverting at least a portion of said hot water through said at least one orifice into the interior of said container to contact the granular detergent in said container.

* * * * *